United States Patent [19]

Ueda et al.

[11] 4,266,009

[45] May 5, 1981

[54] IMAGING MATERIAL AND METHOD OF PRODUCING IMAGE THEREON

[75] Inventors: Takeshi Ueda, Fuji; Kiichiro Sasaguri, Tokyo; Hidehiko Kobayashi, Fuji, all of Japan

[73] Assignee: Asahi Kasei Kogyo Kabushiki Kaisha, Osaka, Japan

[21] Appl. No.: 957,378

[22] Filed: Nov. 2, 1978

[30] Foreign Application Priority Data

Nov. 4, 1977 [JP] Japan ..... 52/131456
Nov. 7, 1977 [JP] Japan ..... 52/132525

[51] Int. Cl.[3] ..... G03C 5/04; G03C 5/24; G03C 1/76

[52] U.S. Cl. ..... 430/346; 430/348; 430/524; 430/526; 430/525; 430/275; 430/276; 430/278; 430/279; 430/496; 430/961; 430/495; 430/273; 427/53.1; 427/56.1; 428/457; 428/913; 250/316.1; 250/317.1; 346/135.1; 346/76 R; 346/76 L

[58] Field of Search ..... 96/88, 27 E, 48 QP, 96/67, 68; 427/53, 56, 53.1, 56.1; 428/457, 913; 346/135, 76 R, 76 L, 135.1; 250/316, 317, 316., 317.1; 430/346, 348, 496, 322, 271, 961, 275, 276, 524, 278, 279, 525, 964, 526, 523, 495, 273

[56] References Cited

U.S. PATENT DOCUMENTS

| | | | |
|---|---|---|---|
| 3,707,372 | 12/1972 | Hallman et al. | 96/27 E |
| 3,996,057 | 12/1976 | Kawaziri et al. | 96/67 |
| 4,000,334 | 12/1976 | Hallman et al. | 96/27 E |
| 4,137,078 | 1/1979 | Izu et al. | 96/48 QP |

FOREIGN PATENT DOCUMENTS

| | | | |
|---|---|---|---|
| 1286503 | 8/1972 | United Kingdom | 96/27 E |

OTHER PUBLICATIONS

Derwent Publications 0929x/06 9-18-1974.

*Primary Examiner*—Won H. Louie, Jr.
*Attorney, Agent, or Firm*—Sprung, Felfe, Horn, Lynch & Kramer

[57] ABSTRACT

A novel imaging material comprising a substrate; a lead layer thereon including at least 20% by weight of lead and having a substantially dome shaped grain structure; and a stabilizing layer formed on said lead layer and comprising a specific metallic element or an organic polymer. The imaging material has a gradation, an excellent resolution and an improved storage stability. The imaging material can form an image thereon by a dry process even in a light room without the conventional development step.

14 Claims, 1 Drawing Figure

FIGURE
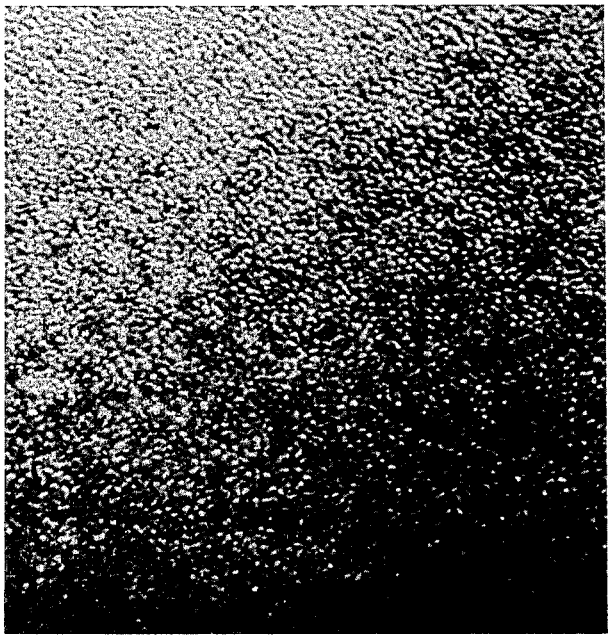

IMAGING MATERIAL AND METHOD OF PRODUCING IMAGE THEREON

The present invention relates to an imaging material. More particularly, the invention relates to a dispersion imaging material having a gradation, an excellent resolution and an improved storage stability.

In Japanese patent application Laid-Open Specification No. 19303/1973, there is proposed an imaging material of the characters such as described below:

(1) The imaging material comprises a substrate and a dispersion imaging layer deposited on the substrate and made of a metal having a relatively low melting point, such as tellurium or bismuth;

(2) The imaging material is exposed to a strong energy emitted from a xenon flash lamp or the like;

(3) When the imaging layer of the imaging material absorbs the energy in an amount above a certain critical threshold value, the metal imaging layer is molten at the areas where subjected to said energy;

(4) The molten metal imaging layer is contracted and dispersed into minute globules by its surface tension;

(5) The optical density of the imaging layer is decreased at the areas where the metal imaging layer is molten and dispersed; and;

(6) Accordingly, a difference in optical density appears in the imaging layer between the areas where subjected to said energy and the areas where not subjected to said energy, whereby an image is formed.

The term "dispersion" as used herein is intended to mean a phenomenon that a continuous, thin solid film of a material becomes discontinuous when the energy absorbed in the material exceeds a certain critical threshold value upon application of the energy. Therefore, the term "dispersion imaging layer" is intended to mean a layer composed of a material capable of bringing about the above defined "dispersion".

The imaging material as mentioned above can form an image thereon by a dry process even in a light room without the conventional development step. Where this imaging material is used, for example, in the field of microfilms, the imaging material is characterized, for example, in that it has a good operability such as mentioned above when compared with conventional imaging materials and in that it has also "add-on" and "annotation" abilities (ability of forming an additional image on the non-imaged areas of an imaged material) which is difficult to obtain in conventional imaging materials.

However, when tellurium or bismuth as mentioned above is employed for the dispersion imaging layer of an imaging material, the gradation and resolution required in the field of microfilms are insufficient. Furthermore, the storage stability is also insufficient as is seen commonly in thin films of metals. The term "storage stability" as used herein is intended to mean the retention of optical density before or after the use of an imaging material and the maintenance of sensitometric characteristics such as gradation, resolution and sensitivity of an imaging material. A thin metal film is liable to undergo oxidation under the influence of oxygen and/or water in the air. The thickness of a thin metal film as an imaging layer of an imaging material for a microfilm, as will be explained later, is usually in the range of 200 to 2,000 Å so that excellent sensitometric characteristics such as sensitivity, resolution, contrast, etc. may be obtained. The thin metal film having such a thickness is especially liable to be easily oxidized, and, hence, not only the optical density is decreased, but also the sensitometric characteristics are affected unfavorably by oxidation. As a method for preventing thin metal films from undergoing oxidation and for imparting to the thin metal films storage stability, there have been proposed some methods in the field of the manufacture of electronic parts and materials, etc. In general, these methods are characterized by provision of an antioxidizing layer such as silicon oxide. However, such as antioxidizing layer has usually a considerable thickness so that, when the antioxidizing layer is applied to an imaging material, it tends to spoil the sensitometric characteristics of the imaging material, even though it improves the storage stability of the imaging material. This is so because the imaging function of the imaging material of the type such as described herein is due mainly to the deformation, i.e., dispersion, of the imaging layer and, therefore, the rigidness of the antioxidizing layer unfavorably acts to depress the deformation of the imaging layer.

It is therefore a principal object of the present invention to provide an imaging material including a dispersion imaging layer having an improved storage stability as well as a gradation and an excellent resolution without such a deterioration in image forming ability as caused by the conventional means such as provision of an antioxidizing layer for improving the storage stability. Another object of the present invention is to provide a method of producing an image on an imaging material of the characters as described above.

The foregoing and other objects, features and advantages of the present invention will be apparent to those skilled in the art from the following detailed description and appended claims taken in connection with the accompanying drawing in which:

FIGURE is a microphotograph of a layer of lead vacuum-deposited on a polyester film which microphotograph is taken at 8,000×magnification by using a scanning electron microscope.

As described hereinbefore, a thin film of bismuth as a dispersion imaging layer gives almost no gradation to an imaging material and the dispersed bismuth globules are large in size, resulting in poor resolution. It is possible to obtain a gradation by partial oxidation of the thin bismuth film as the dispersion imaging layer, but the partial oxidation of the thin bismuth film is unsatisfactory from the viewpoint of resolution because the dispersed globules of the partially oxidized bismuth are considerably far from a spherical shape and are large in size. Generally, an excellent resolution is obtained when the dispersion imaging layer is dispersed into minute globules. The term "globules" as used herein is intended to include not only those having a spherical shape but also those having shapes deformed to some extent.

As a result of our intensive investigations, we have found that a thin lead layer as an imaging layer is useful for making an imaging material having a gradation and an excellent resolution. Lead provides a thin film having a structure comprising substantially dome shaped grains which are substantially vertically oriented with respect to a substrate, if the proper selections are made, for example, with respect to a substrate on which the thin lead layer is deposited and conditions of depositing the thin lead layer. It has been found that, when the thin lead layer as an imaging layer of an imaging material is of substantially dome shaped grain structure, the imaging material has a gradation and an excellent resolution. The term "substantially dome shaped grain structure"

as used herein is intended to indicate a gathering of small grains which are substantially vertically oriented with respect to a substrate as shown in FIGURE which is a microphotograph of a layer of lead vacuum-deposited on a polyester film which microphotograph is taken at 8,000×magnification by using a scanning electron microscope Model JSM-2 (trade name of a product manufactured and sold by Nihon Denshi K. K., Japan) [in respect of a substantially dome shaped grain structure, further reference may be made to Toshinobu Takagi, "Atarashii Hyomenshori Gijutsu (New Techniques of Surface Treatment)" (Tokyo: Hyomenshori Journal Co., 1974) pages 11 to 19]. In general, substantially dome shaped grains of a lead layer has a surface average diameter of about 0.1 mm to 10 mm when enlarged by a scanning electron microscope at 8,000×magnification and, therefore, has an actual surface average diameter of about 0.0125 to 1.25μ. Such grains are often present in the form of two or more grains connected to one another. Due to such a substantially dome shaped grain structure, the lead layer may provide such a property that, when the energy absorbed in the lead layer is converted into heat energy, the transfer of heat to the lateral direction of the layer may be restrained. As a result, it is believed that such a lead layer provides a gradation and that such a lead layer is dispersed into very minute globules when subjected to sufficient energy, leading to the improvement of resolution.

The lead layer having the substantially dome shaped grain structure is especially liable to undergo oxidation under the influence of oxygen and/or water in the air because of its large surface area, resulting in such a drawback as a poor storage stability. In other words, the lead layer having a substantially dome shaped grain structure is rapidly oxidized in the air especially at a high humidity and, hence, the optical density thereof is rapidly decreased. It has been found that one method effective for eliminating such instability of the lead layer is to provide an organic polymer layer on or over the lead layer. It has further been found that the more effective method for such a purpose is to deposit on the lead layer a layer comprising at least one element selected from indium, germanium, antimony and tin. Of course, the combination of these two methods is also very effective. The provision of an organic polymer layer over the lead layer may be realized when the organic polymer layer is provided on the inorganic stabilizing layer deposited on the lead layer.

More specifically, in accordance with the present invention, there is provided an imaging material comprising a substrate; a lead layer formed on the substrate, including at least 20% by weight of lead and having a substantially dome shaped grain structure; and an inorganic stabilizing layer formed on the lead layer and comprising at least 80% by weight of a member selected from the group consisting of indium, germanium, antimony, tin and combinations thereof or an organic stabilizing layer formed on the lead layer and comprising an organic polymer.

An inorganic stabilizing layer comprising at least one of the above-mentioned four elements may have a thickness as extremely small as 5 to 300 Å, especially preferably 10 to 150 Å. A larger thickness of the layer is liable to bring about the decreases of sensitivity and resolution rather than the increase of storage stability. This may be so because the layer of such an element itself may have properties that the layer of the element is difficult to disperse into globules by application of energy and, even if the layer is dispersed by application of energy in a very large amount, the dispersed globules are generally large in size. These properties are recognized, for example, when experiments are conducted using a laminate film composed of a polyester film substrate and a layer of such an element deposited on the substrate and having a considerable thickness.

Of the afore-mentioned four elements to be effectively used for providing an inorganic stabilizing layer for stabilizing the lead layer having the substantially dome shaped grain structure, germanium is most preferable from the viewpoint of not impairing the gradation and resolution which the lead layer provides. One of the reasons is that a layer of germanium, even if very thin, can improve the stability of the lead layer, as compared with layers of the other elements.

As described hereinbefore, one of the methods effective for improving the storage stability of the lead layer is to provide on or over the lead layer an organic stabilizing layer comprising an organic polymer. Specific examples of organic polymers to be used for providing an organic stabilizing layer include polyvinylidene chloride, copolymers of vinylidene chloride and acrylonitrile, polyvinyl acetate, polyvinyl cinnamate, polyisoprene, polybutadiene, polystyrene, polymethyl methacrylate, polyurethanes, polyvinyl butyral, epoxy resins, cellulose acetate, linear saturated polyesters, fluororubbers, silicone rubbers, silicone resins and silicone varnishes. They may be used either alone or in mixture. Optionally, they may also be used in combination in the form of a multi-layer. Of these organic polymers, copolymers of vinylidene chloride and acrylonitrile, linear saturated polyesters [for example, Vylon (trade mark of a product manufactured by Toyo Boseki K. K., Japan)], fluororubbers [for example, Technoflon (trade mark of a product manufactured by Montedison Co., Italy)], silicone resins and silicone varnishes are especially preferred. To the organic polymer, there may be added a silicone oil (about 3% by weight or less per polymer), a crosslinking agent (about 20% by weight or less per polymer), an antistatic agent (about 1% by weight or less per polymer), a surface-active agent (about 1% by weight or less per polymer), etc. for improving processability, film strength and the like.

As described above, as the preferred imaging material of the present invention having an excellent storage stability as well as a gradation and an excellent resolution, there can be mentioned, for example, an imaging material comprising a substrate such as a polyester film, a layer of lead deposited on the substrate and having a substantially dome shaped grain structure, a layer of germanium deposited on the layer of lead and having a thickness of 20 to 80 Å, and a linear saturated polyester layer deposited on the layer of germanium and having a thickness of 0.2 to 2μ.

As a substrate to be used in the imaging material of the present invention, there can be mentioned films of organic polymers such as polyester, cellulose acetate, nitrocellulose, polyethylene, polypropylene, polyvinyl chloride, polyamide, polymethyl methacrylate and polystyrene; and plates of inorganic materials such as glass and mica. Organic polymer films are preferred because the use of an organic polymer film as a substrate facilitates the provision of a substantially dome shaped grain structure in the lead layer. Of organic polymer films, a polyester film is most preferred because the polyester film has not only a good surface smoothness, an excellent heat-resistance and a low moisture absorption but also a good distribution of deposition sites for gaseous lead atoms to be deposited thereon in the form of the lead layer having the substantially dome shaped grain structure.

In order to provide a lead layer having a substantially dome shaped grain structure, it is important to select properly conditions of the deposition of the lead layer in addition to the kind of a substrate. As a method for depositing the lead layer on a substrate, there can be mentioned, for example, dry processes such as vacuum evaporation-deposition, sputtering and ion plating. Of these processes, vacuum evaporation-deposition is preferred. In the process for the deposition of the lead layer, the degree of vacuum, the temperature of the substrate and the rate of deposition of the lead layer are factors in providing a substantially dome shaped grain structure in the lead layer. For example, in a vacuum evaporation-deposition process, the degree of vacuum may be $1\times10^{-7}$ to $1\times10^{-2}$ Torr, preferably $5\times10^{-6}$ to $5\times10^{-4}$ Torr, the temperature of the substrate may be 10° C. to 150° C., preferably 15° to 100° C. and the rate of deposition may be 0.2 to 500 Å/sec., preferably 1 to 200 Å/sec. Under these conditions, a substantially dome shaped grain structure is provided in the lead layer, leading to the provision of a gradation and a high resolution.

The thickness of the lead layer is also one of the important factors that influence the gradation, resolution, etc. Furthermore, the thickness of the lead layer affects the optical density of an imaging material, so it must be decided according to its use. For example, when the imaging material is employed in the field of microfilms, the optical density is preferably in the range of 1.0 to 1.5 which corresponds to the thickness of the lead layer in the range of about 500 to 900 Å. The thickness of the lead layer may be varied depending upon whether or not it includes other element or elements, but may generally be in the range of 200 to 2,000 Å. Too large a thickness of the lead layer tends to impair the gradation and the resolution. The minimum thickness is mainly determined according to the contrast of an image to be formed on the imaging material. The lead layer as an imaging layer is characterized in that it can provide an appropriate and sufficient optical density at such a thickness as will provide a gradation and a high resolution.

The lead layer of the imaging material of the present invention may include an element or elements other than lead in addition to lead. In this sense, the term "lead layer" as used herein is intended to include not only a layer made of lead alone but also a layer made of lead and other element or elements in the form of a mixture, an alloy or a multi-layer. The term "layer of lead" is frequently used herein to mean a layer made of lead alone. In one of the methods for providing a lead layer including other element or elements, an alloy of lead is vacuum evaporated and deposited on a substrate. In another method, lead in a boat is vacuum evaporated and deposited on a substrate simultaneously with another element in another boat or other elements in other boats. In still another method, lead and other element or elements are multilayer-wise deposited. The formation of such a lead layer including other element or elements may preferably be done so that the layer contains much lead at its portion near the substrate. For attaining this, for example, lead is first deposited on the substrate and other element or elements are deposited multilayer-wise. Alternatively, lead is first vacuum evaporated and deposited from a boat therefor on the substrate, and, before completion of the deposition of lead, other element or elements start to be vacuum evaporated and deposited thereon from a boat or boats therefor. In the case of the alloy deposition, for example, an alloy containing 90% by weight of lead is first vacuum evaporated and deposited on the substrate, and an alloy containing 50% by weight of lead is then vacuum evaporated and deposited thereon. By doing so, a substantially dome shaped grain structure may be provided in the lead layer, leading to the improvement of gradation and resolution. Specific examples of elements that may be included in the lead layer of the imaging material of the present invention include bismuth, indium, aluminum, tin, zinc, antimony, selenium, cadmium and tellurium. They may be used either alone or in combination. Of the above-mentioned elements, bismuth is especially preferred. However, too much bismuth tends to cause the storage stability of the lead layer to be insufficient. The above-mentioned elements may be used for improvement of sensitometric characteristics such as gradation, sensitivity and O.D. min. In the case of the combined use of lead and the above-mentioned element or elements, at least 20% by weight of lead, preferably at least 50% by weight of lead based on all the elements of the lead layer, should be contained in the layer. If the content of lead in the lead layer is less than 20% by weight, the gradation and resolution are liable to be poor and the storage stability may not be improved sufficiently by the provision of a stabilizing layer in some cases.

The lead layer is often oxidized in part during and/or after the deposition of the same. As a result, lead oxide is sometimes included in the lead layer. However, when the proportion of lead in the form of lead oxide included in the lead layer is as small as 20% or less in terms of atomic percentage based on the total lead, the influence of lead oxide on the sensitometoric characteristics is small. This is also one of the favorable characteristics of lead as a material of the imaging layer.

As described above, as a material of an inorganic stabilizing layer for eliminating the instability of the lead layer, there can be mentioned four elements, i.e., indium, germanium, antimony and tin. They may be used either alone or in combination in the form of a mixture, an alloy or a multi-layer. Any of these four elements may be deposited on the lead layer by a dry process such as vacuum evaporation-deposition or sputtering.

Of the above-mentioned four elements for the inorganic stabilizing layer, indium, antimony and tin tend to form an alloy with lead. Accordingly, where such an element is to be deposited on the lead layer, the alloy is often formed during or after deposition of the element. It is also probable that an element for the inorganic stabilizing layer forms an alloy with an element other than lead which element is included in the lead layer. However, it is noted that the storage stability is hardly affected adversely by the formation of the alloy. Therefore, the imaging material of this invention may have either an inorganic stabilizing layer which is composed substantially of indium, germanium, antimony, tin or a combination thereof alone or an inorganic stabilizing layer which further includes in the form of an alloy lead and/or other element or elements migrated from the lead layer in addition to indium, germanium, antimony, tin or a combination thereof. In this sense, the material to be deposited on the lead layer for formation of the inorganic stabilizing layer may comprise a small amount of other element or elements in addition to indium, germanium, antimony, tin or a combination thereof. Specific examples of other additional elements include lead, bismuth, aluminum, zinc, selenium, cadmium and tellurium. In any case, it is necessary that the inorganic stabilizing layer should comprise at least 80% by weight, based on all the elements of the layer, of indium, germanium, antimony, tin or a combination thereof.

The reason why any of the above-mentioned four elements deposited on the lead layer can improve the storage stability is not known exactly, but is believed to be that any of the above-mentioned four elements may act on activated points present in the lead layer having the substantially dome shaped grain structure and liable to undergo oxidation to inactivate the same and may provide the lead layer with a much inactivated surface structure by covering the surface of the lead layer. As described hereinbefore, the inorganic stabilizing layer, even if very thin, can exhibit an excellent stabilizing effect, and, hence, the inactivating effect against the activated points is believed to be very large.

Any of the four elements for the inorganic stabilizing layer may often be oxidized during or after deposition of the same on the lead layer, but the storage stability of the lead layer is not affected adversely by the oxidation of the element.

It is conceivable to provide a lead layer containing, in itself, indium, germanium, antimony, tin or a combination thereof in order to improve the storage stability of the lead layer. However, in this case, a sufficient storage stability of the lead layer cannot be obtained. Therefore, it is advantageous to provide the inorganic stabilizing layer on the lead layer having the substantially dome shaped grain structure. However, the lead layer may include indium, antimony, tin or a combination thereof from the viewpoint of improvement of sensitometric characteristics.

An auxiliary stabilizing layer of the same material as that of the inorganic stabilizing layer may be provided between the substrate and the lead layer. In this case, the auxiliary stabilizing layer is deposited on the substrate and the lead layer is deposited thereon, followed by provision, on the lead layer, of another stabilizing layer; namely an inorganic stabilizing layer, an organic stabilizing layer or an inorganic stabilizing layer with an organic stabilizing layer provided thereon. In the case of a lead layer sandwiched between two stabilizing layers, the storage stability may further be improved as compared with that in the case where a stabilizing layer is deposited only on the lead layer. However, in the case where the auxiliary stabilizing layer is provided between the substrate and the lead layer, the auxiliary stabilizing layer is occasionally liable to change the substantially dome shaped grain structure of the lead layer to be deposited on the auxiliary stabilizing layer, leading to the deteriorations of gradation and resolution. Therefore, it is preferred that the auxiliary stabilizing layer which may be formed between the substrate and the lead layer should have a thickness as small as, for example, 2 to 30Å.

As described hereinbefore, an organic stabilizing layer comprising an organic polymer may be provided on the lead layer or the inorganic stabilizing layer for improving storage stability. It is preferred to coat a solution of an organic polymer dissolved in an organic solvent. The coating may be effected by spin coating, roll coating or the like. The thickness of the organic stabilizing layer after drying may preferably be in the range of 0.1 to 5μ, more preferably in the range of 0.2 to 2 μ.

In accordance with another aspect of the present invention, there is provided a method of producing an image by a dry process, which method comprises the step of providing an imaging material comprising a substrate; a lead layer formed on the substrate, including at least 20% by weight of lead and having a substantially dome shaped grain structure; and an inorganic stabilizing layer formed on the lead layer and comprising at least 80% by weight of a member selected from the group consisting of indium, germanium, antimony, tin and combinations thereof or an organic stabilizing layer formed on the lead layer and comprising an organic polymer, and the step of applying to said imaging material energy in an amount sufficient to increase the absorbed energy in the lead layer or the lead layer and the inorganic stabilizing layer above a certain critical threshold value to decrease the optical density at the areas where subjected to said applied energy.

Energy above a certain critical threshold value may be applied in a predetermined pattern to an imaging material of the present invention to form an image thereon. For applying energy in a predetermined pattern to the imaging material, for example, a mask having an appropriately contrasted image may be used. The mask is placed in close contact with the imaging material and energy is applied through the mask to the imaging material to transfer the image to the imaging material. As energy for the transfer of an image, a radient energy having a short pulse width may preferably be employed. Various kinds of flash lamps may be employed as a source of radient energy, but a xenon flash lamp is most preferred. The pulse width of energy emitted from a flash lamp is able to be set at 1 millisecond or less which is preferred in the present invention. As a mask having a sufficient durability to such energy, a chromium mask, a metal mask, a dry silver film mask, a diazo mask or the like may be employed. Such a mask may have a continuous tone or gray scale image.

As energy to be applied to the imaging material of the present invention, there may also be employed infrared rays emitted from an infrared lamp, laser beams, electron beams, heat energy by direct application of a heater or the like. In some cases, energy may be directly applied to the imaging material of the present invention without the use of a mask. The imaging material of the present invention can form thereon a very good image, where energy is applied thereto so that the layer of metallic element is molten and dispersed.

The imaging material of the present invention may be used suitably as a microfilm in the form of a roll, a fiche or a card, a copying film, a film for the production of a printing plate or a material for the production of a printed circuit board.

The present invention will be further illustrated with reference to Examples. Properties described in Examples were measured and evaluated according to the following methods.

(1) Optical density (O.D.):

Optical density is measured using Macbeth Transmission Densitometer TD-500 (trade name of a densitometer manufactured in accordance with rules of ASA-PH 2.19-1959 and sold by Macbeth Co., U.S.A.).

(2) Reduction of optical density:

Reduction of optical density is represented by the following formula:

$$\text{Reduction of O.D.} = 100 - \frac{\text{O.D. after storage of imaging material}}{\text{O.D. just after production of imaging material}} \times 100\ (\%)$$

(3) Gradation:

A mask of Dry Silver No. 7842 (trade name of a dry silver salt type photosensitive film manufactured and solid by Minnesota Mining and Manufacturing Company, U.S.A.) having an image of an 8 step steptablet (manufactured and sold by Eastman Kodak Co., U.S.A.) photographed thereon is placed in close contact with an imaging material. The steptablet has the image wherein the optical density is stepwise changed for the measurement of gradation. The imaging material is exposed through the mask to a flash at 600 volts of a xenon flash lamp (manufactured and sold by EG & G, Inc., U.S.A.) having a pulse width of 50 microseconds and a condenser capacity of 120 $\mu$F which lamp is placed at a distance of 10 mm from the surface of the imaging material.

Optical densities in all the steps of the steptablet image transferred to the imaging material are plotted in relation to the optical densities in the corresponding steps of the steptablet image photographed on the mask, to form a graph having an ordinate representing the optical density of the image on the imaging material and an abscissa representing the optical density of the image on the mask. Gradation is estimated in terms of an inclination of the straight line of the graph. The inclination is referred to as a $\gamma$ value. The smaller the $\gamma$ value, the higher the gradation.

(4) Resolution:

A diazo film mask on which a 1010 resolution test chart in accordance with NBS was photographed is placed in close contact with an imaging material. The imaging material is exposed through the mask to a flash. The obtained image is observed using an optical microscope BHC-312-M type (trade name of an optical microscope manufactured and sold by Olympus Kogaku Kogyo K.K., Japan) and the resolution is measured.

(5) Storage stability:

An imaging material is stored in a thermo-hygrostat maintained at a temperature of 60° C. and at a relative humidity of 70%. Storage stability is evaluated in terms of reduction of optical density and changes of gradation and resolution with the lapse of time.

The following examples illustrate the present invention in more detail so as to further clarify the mode of practice thereof, but are not to be construed as limiting the scope of the present invention because many variations and modifications thereof are possible.

EXAMPLE 1 AND COMPARATIVE EXAMPLE 1

A 750Å-thick film of lead was deposited by vacuum evaporation-deposition technique on a 100 $\mu$-thick polyester film under the following conditions.

| | |
|---|---|
| Purity of lead: | 99.999% by weight |
| Material of evaporation boat: | Ta |
| Distance between boat and polyester film: | 20 cm |
| Temperature of polyester film: | 30° C. |
| Degree of vacuum | $2 \times 10^{-5}$ Torr |
| Rate of deposition: | 5A/sec. |

The 750Å-thick film of lead as a lead layer had an optical density of 1.3 and had a substantially dome shaped grain structure when it was observed by a scanning electron microscope. Model JSM-2, (trade name of a product manufactured and sold by Nihon Denshi K.K., Japan). The obtained construction (imaging material 1) with the lead layer deposited on the polyester film provided excellent sensitometric characteristics, that is, the $\gamma$ value was 3.5 and the resolution was 180 lines/mm. However, the construction was poor in storage stability, that is, the reduction of optical density was 75% after storage at a temperature of 60° C. at a relative humidity of 70% for one hour.

After the storage under the above-mentioned conditions, the $\gamma$ value and the resolution of the imaging material 1 could not be measured. Therefore, when the reduction of optical density was 20% after storage at a temperature of 60° C. at a relative humidity of 70% for 20 minutes, the measurements were conducted. The $\gamma$ value was 8 and the resolution was 100 lines/mm.

A 750Å-thick film of lead was deposited on a 100 $\mu$-thick polyester film in the same manner as described above and a 50Å-thick film of germanium (purity: 99.999% by weight) as an inorganic stabilizing layer was then deposited thereon from a tantalum boat by vacuum evaporation-deposition technique in substantially the same manner as described above to form an imaging material 2.

A 6% by weight solution of Vylon (trade mark of a linear saturated polyester manufactured and sold by Toyo Boseki K.K., Japan) dissolved in ethoxyethyl acetate was coated by spin coating technique on the deposited layers of the imaging materials 1 and 2 and then dried to form imaging materials 3 and 4 having a 0.5 $\mu$-thick Vylon layer, respectively. The properties of the imaging materials were measured to obtain the results as shown in Table 1. The storage stabilities were evaluated after storage at a temperature of 60° C. at a relative humidity of 70% for 7 days.

TABLE 1

| Imaging Material | Coating | Before Storage $\gamma$ | Before Storage Resolution (lines/mm) | Reduction of O.D. (%) | After Storage $\gamma$ | After Storage Resolution (lines/mm) |
|---|---|---|---|---|---|---|
| 3 | coated | 3.0 | 200 | 10 | 3.5 | 180 |
| 2 | none | 3.5 | 180 | 6 | 3.5 | 180 |
| 4 | coated | 3.0 | 200 | 4 | 3.0 | 200 |

COMPARATIVE EXAMPLE 2

A 360Å-thick film of bismuth was deposited by vacuum evaporation-deposition technique on a 100 $\mu$-thick polyester film under the following conditions.

| | |
|---|---|
| Purity of bismuth: | 99.99% by weight |
| Material of evaporation boat: | W |
| Distance between boat and polyester film: | 20 cm |
| Temperature of polyester film: | 25° C. |
| Degree of vacuum: | $2 \times 10^{-5}$ Torr |
| Rate of deposition: | 5A/sec. |

The 360Å-thick film of bismuth had an optical density of 1.35 and did not have a substantially dome shaped grain structure when it was observed by the same scanning electron microscope as used in Example 1. The obtained construction (imaging material) with the bismuth layer deposited on the polyester film provided poor sensitometric characteristics, that is, the $\gamma$ value was 25 and the resolution was 70 lines/mm. The reduction of optical density was 35% after storage at a temperature of 60° C. at a relative humidity of 70% for 7 days.

The same solution of Vylon as used in Example 1 was coated by spin coating technique on the deposited bismuth layer of the construction and then dried to form an imaging material having a 0.5 $\mu$-thick Vylon layer. The imaging material with the Vylon layer provided a $\gamma$ value of 20 and a resolution of 80 lines/mm. The reduction of optical density was 28% after storage at a temperature of 60° C. at a relative humidity of 70% for 7 days.

A 60Å-thick film of germanium was deposited on the deposited bismuth layer of the construction in the same manner as described in Example 1 to form an imaging material. The imaging material with the germanium layer provided a resolution of 50 lines/mm. The reduction of optical density was 25% after storage at a temperature of 60° C. at a relative humidity of 70% for 7 days.

EXAMPLE 2

Imaging materials were prepared in substantially the same manner as described in Example 1 except that indium, antimony and tin were respectively used as an element of an inorganic stabilizing layer in place of germanium. All of the imaging materials were provided with substantially the same Vylon layer as in Example 1. The properties of the imaging materials were measured to obtain the results as shown in Table 2. The storage stabilities were evaluated after storage at a temperature of 60° C. at a relative humidity of 70% for 7 days.

TABLE 2

| Element of Stabilizing Layer | Thickness of Stabilizing Layer (A) | Before Storge | | After Storage | | |
|---|---|---|---|---|---|---|
| | | $\gamma$ | Resolution (lines/mm) | Reduction of O.D. (%) | $\gamma$ | Resolution (lines/mm) |
| In | 100 | 3.5 | 160 | 8 | 3.0 | 150 |
| Sb | 60 | 3.0 | 200 | 6 | 3.0 | 180 |
| Sn | 100 | 3.5 | 180 | 6 | 3.0 | 160 |

EXAMPLE 3

Imaging materials were prepared in substantially the same manner as described in Example 1 except that the thickness of a germanium layer as an inorganic stabilizing layer was changed. All of the imaging materials were provided with a 0.6 $\mu$ thick layer of Technoflon (trade mark of a fluororubber manufactured and sold by Montedison Co., Italy) in place of a Vylon layer. A solution of Technoflon used for spin coating had the following composition:

| | |
|---|---|
| Technoflon: | 5% by weight |
| Technocine (trade mark of a cross-linking agent manufactured and sold by Montedison Co., Italy): | 0.25% by weight |
| Methyl ethyl ketone: | 44.75% by weight |
| Ethoxyethyl acetate: | 50% by weight |

The properties of the imaging materials were measured to obtain the results as shown in Table 3. The storage stabilities were evaluated after storage at a temperature of 60° C. at a relative humidity of 70% for 7 days.

TABLE 3

| Thickness of Germanium Layer (A) | Before Storage | | After Storage | | |
|---|---|---|---|---|---|
| | $\gamma$ | Resolution (lines/mm) | Reduction of O.D.(%) | $\gamma$ | Resolution (lines/mm) |
| 15 | 3.0 | 180 | 10 | 2.5 | 150 |
| 40 | 3.0 | 200 | 5 | 3.0 | 200 |
| 100 | 4.0 | 160 | 3 | 3.5 | 160 |
| 200 | 6.0 | 130 | 7 | 6.0 | 130 |

EXAMPLE 4

A semi-continuous vacuum evaporation-deposition and sputtering machine including a film payoff system and a film takeup system was used for the preparation of an imaging material. A vacuum evaporation-deposition zone and a sputtering zone were located near a water cooled roll. In the vacuum evaporation-deposition zone, a molybdenum boat containing lead (purity: 99.999% by weight) was located at a distance of 15 cm from the surface of the water cooled rool. In the sputtering zone, a germanium target was attached to a water cooled plate and surrounded with an enclosure having a hole for introducing an argon gas. The machine was pumped down to a vacuum of about $1\times10^{-5}$ Torr by means of a pumping system and the sputtering zone was then filled back with an argon gas to a vacuum of about $5\times10^{-3}$. At such a vacuum in the sputtering zone, the vacuum in the vacuum evaporation-deposition zone was about $1\times10^{-4}$ Torr.

A 125 $\mu$-thick polyester film as a substrate was advanced from a payoff roll over the water cooled roll to the takeup roll at a speed of 1 m/min. In the vacuum evaporation-deposition zone, lead was deposited on the polyester film to form a lead layer. The deposition rate of lead was 100 Å/sec. The thickness of the lead layer was 700 Å. During the deposition of lead, the surface temperature of the polyester film was increased to 70°-80° C. In the sputtering zone, germanium was deposited by RF sputtering technique on the lead layer of the lead-deposited polyester film which had left the vacuum evaporation-deposition zone, to form a germanium layer as an inorganic stabilizing layer. The thickness of the germanium layer was 40 Å. The lead layer with the germanium layer deposited thereon had a substantially dome shaped grain structure when observed using the same scanning electron microscope as used in Example 1. The grains in the structure were small in size as compared with those in the structure observed in Example 1.

The wound-up film was then subjected to roll coating of two kinds of organic polymer solutions. A solution of 10% by weight of Vylon and 0.1% by weight of a silicone oil KP 358 (trade name of a product manufactured and sold by Shinetsu Kagaku K.K., Japan) dissolved in a mixed solvent of ethoxyethyl acetate-cyclohexanone (80/20 by weight) was first coated on the germanium layer and dried to form a Vylon layer having a dry thickness of 0.4 $\mu$. Subsequently, a 3% by weight solution of a silicone resin FS×F - 2207 (trade name of a product manufactured and sold by Dow Corning Co., U.S.A.) dissolved in n-heptane was coated on the Vylon layer and dried to form a silicone resin layer having a dry thickness of 0.2 $\mu$.

The properties of the imaging material thus obtained were measured to obtain the following results.

O.D. max = 1.40
$\gamma = 3.0$
Resolution = 220 lines/mm
Storage stability (after storage at a temperature of 60° C. at a relative humidity of 70% for one month)
Reduction of O.D. = 4%
$\gamma$ = not substantially changed
Resolution = not substantially changed.

A clear image was produced on the imaging material by using either a laser beam spot having a diameter of 2 μor a thermal head of 10 μ × 100 μ.

EXAMPLE 5

A 500 Å-thick film of lead was deposited by vacuum evaporation-deposition technique on a 100 μ-thick polyester film, a 150 Å-thick of bismuth was deposited by vacuum evaporation-deposition technique on the layer of lead and a 70 Å-thick film of germanium was deposited by vacuum evaporation-deposition technique on the layer of bismuth. The deposition conditions were substantially the same as described in Example 1.

The deposited layer composed of lead, bismuth and germanium had a substantially dome shaped grain structure in which the grains were relatively large in size, when observed using the same scanning electron microscope as used in Example 1.

The same solution of Vylon as used in Example 1 was coated by spin coating technique on the deposited layer and then dried to form an imaging material having a 0.3 μ-thick Vylon layer. The imaging material provided a $\gamma$ value of 2.5 and a resolution of 180 lines/mm. The imaging material was stored at a temperature of 60° C. at a relative humidity of 70% for 7 days. The reduction of optical density was 10% and the $\gamma$ value after the storage was 2.0. The resolution was not changed substantially by the storage.

Substantially the same imaging material as described above except that a 650 Å-thick layer of lead was provided instead of the layer of lead and the layer of bismuth was prepared in substantially the same manner as described above. The imaging material with the layer of bismuth was improved in sensitivity as compared with the imaging material without the layer of bismuth.

EXAMPLE 6

Vacuum evaporation-deposition was carried out at a vacuum of $2 \times 10^{-5}$ Torr by using three boats in which lead, cadmium and germanium were contained respectively. Above each boat, there was disposed a monitor for measuring the thickness of a deposited film. A 100 μ-thick polyester film was placed at a distance of 20 cm from the respective boats. Three shutters were disposed between the polyester film and the three boats, respectively. During the vacuum evaporation-deposition, the polyester film had a temperature of 30° C. and was rotated in a horizontal plane.

The boat containing lead and the boat containing cadmium were heated and the shutter above the boat containing lead was opened to deposit lead on the polyester film until the monitor indicated the thickness of the deposited lead film to be 150 Å.

Then, the shutter above the boat containing cadmium was opened to deposit on the deposited lead film cadmium simultaneously with lead. The deposition was conducted at such a rate that any of lead and cadmium would have been deposited at a rate of 10 Å/sec. in single deposition of the same. When both of the monitor above the boat containing lead and the monitor above the boat containing cadmium indicated the thickness of the deposited film to be 300 Å, the shutter above the boat containing lead was shut and a 100 Å-thick film of cadmium alone was further deposited on the deposited film of lead and cadmium. Subsequently, the shutter above the boat containing cadmium was shut, and the boat containing germanium was heated and the shutter above the boat containing germanium was opened to deposit germanium on the deposited cadmium film until the monitor indicated the thickness of the deposited germanium film to be 50 Å. The same solution of Technoflon as used in Example 1 was coated on the deposited germanium film in the same manner as described in Example 3 and then dried to form an imaging material. The thickness of the Technoflon layer was 0.6 μ.

The properties of the imaging material thus obtained were measured to obtain the following results.

O.D. max = 1.20
$\gamma = 2.5$
Resolution = 180 lines/mm
Storage stability (after storage at a temperature of 60° C. at a relative humidity of 70% for 7 days)
Reduction of O.D. = 8%
$\gamma = 3.0$
Resolution = 160 lines/mm

EXAMPLE 7

Vacuum evaporation-deposition was carried out under substantially the same conditions as described in Example 1. A 10 Å-thick film of germanium was deposited as an auxiliary stabilizing layer on a 125μ-thick polyester film, a 300 Å-thick film of lead was deposited thereon, a 250 Å-thick film of bismuth was then deposited thereon, and, in turn, a 50 Å-thick film of germanium was deposited thereon as an inorganic stabilizing layer.

A 7% by weight solution of Saran (trade mark) F-310 (trade name of a vinylidene chloride-acrylonitrile copolymer manufactured and sold by Dow Chemical Co., U.S.A.) dissolved in a mixed solvent of methyl ethyl ketone-ethoxyethyl acetate (50/50 by weight) was coated by spin coating technique on the deposited layer and then dried to form an imaging material having a 0.8μ-thick Saran F-310 layer.

The properties of the imaging material thus obtained were measured to obtain the following results.

O.D. max = 1.25
$\gamma = 2.5$
Resolution = 180 lines/mm
Reduction of O.D. = 5% (after storage at a temperature of 60° C. at a relative humidity of 70% for 10 days)

An imaging material were prepared in substantially the same manner as described above except that the deposition of the auxiliary stabilizing layer was omitted. The properties of the imaging material were measured to obtain the following results.

$\gamma = 2.0$
Resolution = 180 lines/mm
Reduction of O.D. = 8% (after storage at a temperature of 60° C. at a relative humidity of 70% for 10 days)

An imaging material was prepared in substantially the same manner as described hereinbefore except that a 40 Å-thick film of germanium was deposited as an auxiliary stabilizing layer instead of the 10 Å-thick film of germanium. The properties of the imaging material was measured to obtain the following results.

$\gamma = 5.0$
Resolution = 140 lines/mm

Reduction of O.D. = 4% (after storage at a temperature of 60° C. at a relative humidity of 70% for 10 days)

EXAMPLE 8

Under substantially the same vacuum evaporation-deposition conditions as described in Example 1, a 20 Å-thick film of indium was deposited on a 125μ-thick polyester film, a 800 Å-thick film of lead was deposited thereon and a 50 Å-thick film of indium was then deposited thereon. The same solution of Vylon as used in Example 1 was coated by spin coating technique on the deposited film and then dried to form an imaging material having a 1.2μ-thick Vylon layer. The properties of the imaging material were measured to obtain the following results.

O.D. max = 1.40

$\gamma = 3.0$

Resolution = 160 lines/mm

Reduction of O.D. = 6% (after storage at a temperature of 60° C. at a relative humidity of 70% for 2 weeks)

EXAMPLE 9

An alloy of lead and bismuth was prepared and put into a boat. The alloy was evaporated from the boat and deposited on a 100μ-thick polyester film to form a 1,000 Å-thick film composed substantially of 80% by weight of lead and 20% by weight of bismuth. The vacuum evaporation-deposition conditions were as follows.

| | |
|---|---|
| Temperature of polyester film: | 40° C. |
| Degree of vacuum: | $2 \times 10^{-4}$ Torr |
| Rate of deposition: | 10 A/sec. |

Subsequently, a 50 Å-thick of germanium was deposited on the deposited film of lead and bismuth under substantially the same conditions as described above.

The same solution of Vylon as used in Example 1 was coated by spin coating technique on the deposited film and then dried to form an imaging material having a 0.6μ-thick Vylon layer. The properties of the imaging material were measured to obtain the following results.

O.D. max = 1.1

$\gamma = 3.0$

Resolution = 180 lines/mm

Reduction of O.D. = 12% (after storage at a temperature of 60° C. at a relative humidity of 70% for 7 days)

EXAMPLE 10 AND COMPARATIVE EXAMPLE 3

Vacuum evaporation-deposition was carried out at a vacuum of $2 \times 10^{-5}$ Torr by using a boat containing lead and a boat containing antimony. Lead and antimony were simultaneously deposited on a 100μ-thick polyester film maintained at a temperature of 30° C. at such a rate of deposition that lead would have been deposited at a rate of 10 Å/sec. in single deposition of the same and that antimony would have been deposited at a rate of 1 Å/sec. in single deposition of the same. An imaging material having a 770 Å-thick layer of lead and antimony deposited on the polyester film was obtained. With respect to this imaging material, the reduction of optical density was 20% after storage at a temperature of 60° C. at a relative humidity of 70% for 7 days.

A 100 Å-thick film of antimony alone was further deposited on the deposited layer of the same imaging material as described above to form an imaging material. With respect to this imaging material, the reduction of optical density was 8% after storage at a temperature of 60° C. at a relative humidity of 70% for 7 days.

The same solution of Saran F-310 as used in Example 7 was coated by spin coating technique on the deposited antimony film of the same imaging material as described just above and then dried to form an imaging material having a 0.7μ-thick Saran F-310 layer. The properties of this imaging material were measured to obtain the following results.

$\gamma = 3.0$

Resolution = 160 lines/mm

Reduction of O.D. = 5% (after storage at a temperature of 60° C. at a relative humidity of 70% for 7 days)

EXAMPLE 11 AND COMPARATIVE EXAMPLE 4

Lead was deposited on a 100μ-thick polyester film and bismuth was then deposited thereon under the following vacuum evaporation-deposition conditions.

| | |
|---|---|
| Temperature of polyester film: | 40° C. |
| Degree of vacuum: | $5 \times 10^{-5}$ Torr |
| Rate of deposition: | 10 A/sec. |

After deposition of bismuth, a 50 Å-thick film of germanium was further deposited on the deposited bismuth film under the same conditions as described in Example 1. Subsequently, the same solution of Saran F-310 as used in Example 7 was coated by spin coating technique on the deposited germanium film to form an imaging material having a 0.8μ-thick Saran F-310 layer.

According to the procedures as described above, there were prepared three kinds of imaging materials which differed in the proportion of lead to the total of lead and bismuth. The properties of the imaging materials were measured to obtain the results as shown in Table 4. The storage stabilities were evaluated after storage at a temperature of 60° C. at a relative humidity of 70% for 7 days.

TABLE 4

| Imaging Material | Proportion of Lead* (% by weight) | Before Storage O.D. | Before Storage γ | Before Storage Resolution (lines/mm) | After Storage Reduction of O.D. (%) |
|---|---|---|---|---|---|
| 1 | 60 | 1.35 | 2.0 | 160 | 12 |
| 2 | 30 | 1.30 | 5.0 | 130 | 16 |
| 3 | 10 | 1.30 | 10.0 | 100 | 30 |

Note)

$$\text{*Proportion of Lead} = \frac{X \times 11.34}{X \times 11.34 + Y \times 9.80} \times 100\ (\%)$$

wherein X stands for a thickness (Å) of a deposited lead film and Y stands for a thickness (Å) of a deposited bismuth film.

When the imaging materials were observed by the same scanning electron microscope as used in Example 1, the imaging material 1 had a substantially dome shaped grain structure in which the grains were relatively large in size, the imaging material 2 had a substantially dome shaped grain structure in which the grains were relatively small in size and the imaging material 3 had no substantially dome shaped grain structure.

EXAMPLE 12

Substantially the same imaging materials with the 40 Å-thick germanium layer as described in Example 3 except that the thickness of a Technoflon layer was changed were prepared in substantially the same manner as described in Example 3. The thickness of a Technoflon layer was controlled by changing the amount of the mixed solvent in the composition as described in Example 3. The properties of the imaging materials were measured to obtain the results as shown in Table 5. The storage stabilities were evaluated after storage at a temperature of 60° C. at a relative humidity of 70% for 7 days.

TABLE 5

| Thickness of Technoflon Layer (μ) | Before Storage γ | Before Storage Resolution (lines/mm) | After Storage Reduction of O.D. (%) |
|---|---|---|---|
| 1.0 | 3.0 | 180 | 4 |
| 2.0 | 3.5 | 140 | 4 |
| 4.0 | 5.0 | 100 | 3 |

EXAMPLE 13 AND COMPARATIVE EXAMPLE 5

An alloy of antimony and bismuth was prepared and put into a boat. Under substantially the same conditions as described in Example 1, a 700 Å-thick film of lead was deposited on a 100μ-thick polyester film and the alloy of antimony and bismuth was deposited thereon from the boat.

According to the procedures as described above, there were prepared two kinds of imaging materials which differed in the content of antimony in the alloy layer. Two kinds of alloys of antimony and bismuth which alloys differed in composition were used for two kinds of the imaging materials, respectively. The properties of the imaging materials were measured to obtain the results as shown in Table 6. The storage stabilities were evaluated after storage at a temperature of 60° C. at a relative humidity of 70% for 7 days.

TABLE 6

| Sb-Bi Alloy Layer: Content of Sb (% by weight) | Sb-Bi Alloy Layer: Thickness of Layer (A) | Before Storage γ | Before Storage Resolution (lines/mm) | After Storage Reduction of O.D. (%) |
|---|---|---|---|---|
| 90 | 80 | 3.0 | 200 | 12 |
| 60 | 120 | 2.5 | 180 | 20 |

What is claimed is:

1. An imaging material comprising a substrate; a lead layer formed on the substrate and having a substantially dome shaped grain structure, said lead layer consisting of lead, or at least 20% by weight of lead and a member selected from the group consisting of bismuth, indium, aluminum, tin, zinc, antimony, cadmium and combinations thereof; and an inorganic stabilizing layer formed on the lead layer and consisting of a member selected from the group consisting of indium, germanium, antimony, tin and combinations thereof, or at least 80% by weight of a member selected from the group consisting of indium, germanium, antimony, tin and combinations thereof and a member selected from the group consisting of lead, bismuth, aluminum, zinc, cadmium and combinations thereof.

2. An imaging material as claimed in claim 1, which further comprises an organic stabilizing layer formed on the inorganic stabilizing layer and comprising an organic polymer.

3. An imaging material as claimed in claim 1, wherein said lead layer has a thickness of 200 to 2,000 Å.

4. An imaging material as claimed in claim 1, wherein said inorganic stabilizing layer has a thickness of 5 to 300 Å.

5. An imaging material as claimed in claim 1, wherein said inorganic stabilizing layer is substantially of germanium.

6. An imaging material as claimed in claim 2, wherein said organic polymer layer comprises a member selected from the group consisting of copolymers of vinylidene chloride and acrylonitrile, linear saturated polyesters, fluororubbers, silicone resin, silicone varnishes and combinations thereof.

7. An imaging material as claimed in claim 2, wherein said organic polymer layer has a thickness of 0.1 to 5μ.

8. An imaging material as claimed in claim 1, wherein said lead layer is substantially of lead.

9. An imaging material as claimed in claim 1, wherein said lead layer consisting of at least 20% by weight of lead and a member selected from the group consisting of bismuth, indium, aluminum, tin, zinc, antimony, selenium, cadmium, tellurium and combinations thereof.

10. An imaging material as claimed in claim 1, which further comprises an auxiliary stabilizing layer formed between said substrate and said lead layer and having a thickness of 2 to 30 Å, said auxiliary stabilizing layer consisting of a member selected from the group consisting of indium, germanium, antimony, tin and combination thereof, or at least 80% by weight of a member selected from the group consisting of indium, germanium, antimony, tin and combinations thereof and a member selected from the group consisting of lead, bismuth, aluminum, zinc, cadmium and combinations thereof.

11. A method of producing an image by a dry process, which method comprises the step of providing an imaging material comprising a substrate; a lead layer formed on the substrate and having a substantially dome shaped grain structure, said lead layer consisting of lead or at least 20% by weight of lead and a member selected from the group consisting of bismuth, indiu, aluminum, tin, zinc, antimony, cadmium and combinations thereof; and an inorganic stabilizing layer formed on the lead layer and consisting of a member selected from the group consisting of indium, germanium, antimony, tin and combinations thereof, or at least 80% by weight of a member sel selected from the group consisting of indium, germanium, antimony, tin and combinations thereof and a member selected from the group consisting of lead, bismuth, aluminum, zinc, cadmium and combinations thereof, and the step of applying to said imaging material energy in an amount sufficient to increase the absorbed energy in the lead layer or the lead layer and the inorganic stabilizing layer above a certain critical threshold value to decrease the optical density at the areas where subjected to said applied energy.

12. A method of producing an image by a dry process as claimed in claim 11, wherein said imaging material further comprises an organic stabilizing layer formed on the inorganic stabilizing layer and comprising an organic polymer.

13. A method of producing an image by a dry process as claimed in claim 11 or 12, wherein said imaging material further comprises an auxiliary stabilizing layer formed between said substrate and said lead layer and comprising at least 80% by weight of a member selected from the group consisting of indium, germanium, antimony, tin and combinations thereof and a member selected from the group consisting of bismuth, indium, aluminum, tin, zinc, antimony, cadmium and combinations thereof; and an inorganic stabilizing layer formed on the lead layer and consisting of a member selected from the group consisting of indium, germanium, antimony, tin and combinations thereof, or at least 80% by weight of a member selected from the group consisting of indium, germanium, antimony, tin and combinations thereof and a member selected from the group consisting of lead, bismuth, aluminum, zinc, cadmium and combinations thereof.

14. A method of producing an image by a dry process as claimed in claim 11, wherein said energy is radiant energy having a short pulse width and is applied through a mask having an image thereon to said imaging material.

* * * * *